US008831445B2

(12) United States Patent
Otake

(10) Patent No.: US 8,831,445 B2
(45) Date of Patent: Sep. 9, 2014

(54) IMAGE FORMING APPARATUS HAVING DUAL SPEED STIRRING CONTROL

(75) Inventor: Masaki Otake, Nagareyama (JP)

(73) Assignee: Canon Kabushiki Kaisha, Tokyo (JP)

( * ) Notice: Subject to any disclaimer, the term of this patent is extended or adjusted under 35 U.S.C. 154(b) by 523 days.

(21) Appl. No.: 13/111,077

(22) Filed: May 19, 2011

(65) Prior Publication Data

US 2011/0286754 A1 Nov. 24, 2011

(30) Foreign Application Priority Data

May 21, 2010 (JP) ..... 2010-117724

(51) Int. Cl.
*G03G 15/08* (2006.01)

(52) U.S. Cl.
CPC .... *G03G 15/0831* (2013.01); *G03G 2215/0802* (2013.01); *G03G 15/0827* (2013.01); *G03G 2215/0894* (2013.01)
USPC ..... 399/27; 399/61; 399/64; 399/254

(58) Field of Classification Search
USPC ..... 399/27, 61, 64
See application file for complete search history.

(56) References Cited

U.S. PATENT DOCUMENTS

| | | | | |
|---|---|---|---|---|
| 5,589,918 | A * | 12/1996 | Oshida et al. | 399/114 |
| 6,970,657 | B2 * | 11/2005 | Suenaga et al. | 399/27 |
| 7,499,656 | B2 * | 3/2009 | Kimura et al. | 399/27 |
| 2001/0050706 | A1 * | 12/2001 | Ishii | 347/254 |
| 2008/0219686 | A1 * | 9/2008 | Yamagata | 399/53 |
| 2009/0010659 | A1 * | 1/2009 | Watanabe | 399/27 |
| 2010/0232815 | A1 * | 9/2010 | Zheng | 399/27 |
| 2010/0322643 | A1 * | 12/2010 | Yagi et al. | 399/27 |
| 2011/0280591 | A1 * | 11/2011 | Suzuki | 399/27 |
| 2012/0230730 | A1 * | 9/2012 | Ogino | 399/119 |
| 2014/0079415 | A1 * | 3/2014 | Fukasawa et al. | 399/27 |
| 2014/0079416 | A1 * | 3/2014 | Hirukawa et al. | 399/27 |
| 2014/0086599 | A1 * | 3/2014 | Gofuku et al. | 399/27 |
| 2014/0093257 | A1 * | 4/2014 | Seto | 399/25 |

FOREIGN PATENT DOCUMENTS

JP 2003-241500 A 8/2003

* cited by examiner

*Primary Examiner* — David Gray
*Assistant Examiner* — Geoffrey Evans
(74) *Attorney, Agent, or Firm* — Fitzpatrick, Cella, Harper & Scinto

(57) ABSTRACT

An image forming apparatus includes an image bearing member for bearing a latent image, a developer carrying member for developing the latent image with a developer, a developer accommodating portion for accommodating the developer, and a detecting device including a light emitting element and a light receiving element for detecting a remaining developer amount in the developer accommodating portion. In addition, a stirring member stirs the developer by rotating in the developer accommodating portion. The stirring member is rotated in a first period in which the stirring member crosses an optical path of light from the light emitting element toward the light receiving element and a second period in which the stirring member does not cross the optical path of the light. The stirring member is rotated at a first rotational speed in the first period and is rotated at a second rotational speed in the second period higher than the first rotational speed, and wherein the first period and the second period are included in one rotation of the stirring member.

5 Claims, 9 Drawing Sheets

(a)

(b)

IMAGE FORMING APPARATUS HAVING DUAL SPEED STIRRING CONTROL

FIELD OF THE INVENTION AND RELATED ART

The present invention relates to an image forming apparatus of an electrophotographic type, such as a copying machine, a printer or a facsimile machine. Particularly, the present invention relates to the image forming apparatus of the electrophotographic type in which a latent image is formed on an image bearing member and is developed with a developer such as toner to obtain a visible image.

For example, in the image forming apparatus of the electrophotographic type such as the printer, a photosensitive drum which is the image bearing member is uniformly charged and is selectively exposed to light to form the latent image, and then the latent image is visualized by fine powdery toner, which is developer, to obtain the visible image (i.e., a toner image). The toner image is transferred onto a recording material and then the transferred toner image is subjected to application of heat and pressure to be fixed on the recording material, thus effecting image recording.

In such an image forming apparatus, a remaining toner amount detecting device is provided in order to measure a remaining amount of the developer (hereinafter referred to as the toner) in a toner container in which the toner is accommodated. The remaining toner amount detecting device is of various types. As an inexpensive and simple constitution, there is a light transmission remaining toner amount detection type as described in Japanese Laid-Open Patent Application (JP-A) No. 2003-241500. In the light transmission remaining toner amount detection type, detection light is caused to pass through an inside of the toner container and the remaining amount of the toner accommodated in the toner container is detected on the basis of a passing time of the detection light.

A constitution of the light transmission remaining toner amount detection device described in JP-A 2003-241500 will be described. According to the light transmission remaining toner amount detection device, the detection light emitted from a light emitting member such as a light emitting element passes through a first guide portion which is a light transmitting member to enter the inside of the toner container via a first light transmitting window member provided on the toner container. Further, the detection light having entered the inside of the toner container passes through the inside of the toner container to come out of the toner container via a second light transmitting window member provided on the toner container. Further, the detection light having come out of the toner container reaches a light receiving member, such as an LED for remaining toner amount detection, via a second guide member which is the light transmitting member. On the basis of a length of time when the light receiving member receives the detection light, a remaining developer amount in the toner container is detected.

Incidentally, a sheet member of a toner feeding portion in the toner container enters the first light transmitting window member and the second light transmitting window member in a depth of about 0.5 mm to about 4 mm at a part thereof with respect to a longitudinal area, thus also functioning as means for wiping off the toner deposited on surfaces of the first light transmitting window member and the second light transmitting window member. By employing such a constitution, even when the light transmitting window members are covered with the toner, the light transmitting window members are wiped with the sheet member, so that the detection light can pass through the inside of the toner container. In a state in which the toner is accommodated in a large amount in the toner container, even when the sheet member wipes the surfaces of the window members, the surfaces of the window members are covered with the toner immediately and are light-blocked by the toner, so that the time when the detection light passes through the inside of the toner container is short.

However, when the remaining toner amount is decreased by consumption of the toner in the toner container, an interval from the wiping of the window members with the sheet member until the window members are covered with the toner again is increased, so that a passing time of the detection light through the inside of the toner container correspondingly becomes long. Thus, in the light transmission remaining toner amount detection device, the remaining toner amount is measured depending on a change in length of time when the detection light passes through the inside of the toner container. That is, in the state in which the toner is accommodated in a large amount in the toner container, the detection light does not pass through the inside of the toner container. On the other hand, in the case of a state of the consumption of the toner, the detection light starts to pass through the inside of the toner container and a detection time becomes long. Further, in the case where the detection light passing time when the toner in the toner container is used up is set as a threshold in advance, when the passing time of the detection light having passed through the inside of the toner container exceeds the threshold, it is possible to notify a user of no toner in the toner container.

Further, a remaining toner amount detection sequence in which the passing time of the detection light having passed through the inside of the toner container and the remaining toner amount in the toner container are associated with each other is prepared. As a result, it becomes possible to perform real-time detection of the remaining toner amount by which the remaining toner amount in the toner container is notified to the user in real time correspondingly to the detection light passing time in the toner container.

However, in the electrophotographic image forming apparatus in recent years, with speed-up of a printing speed, a speed of the stirring member in the toner container also becomes high and therefore the toner is scattered in the toner container, so that the light cannot reach the LED for remaining toner amount detection. For that reason, there is a possibility of an erroneous detection as a toner presence state.

That is, according to the constitution of JP-A 2003-241500, the remaining toner amount detection device is operable in a rough detection mode in which a toner stirring member driving speed is variable and the remaining toner amount is roughly detected and a fine detection mode in which the remaining toner amount is accurately detected. Further, after the remaining amount is detected in the rough detection mode, an operation in the fine detection mode was executed with timing such as during stand-by other than a printing period or during an interval between jobs.

However, in the case where the operation in the fine detection mode in which the remaining toner amount is detected is executed in a state in which the toner is consumed and is small in remaining amount, there is a need to lower a stirring speed. Further, in the case where high-speed printing is effected while keeping a printing quality, there was a need to supply the toner in a sufficient amount to a detecting roller.

For that reason, during the high-speed printing, when the remaining toner amount is small even during continuous printing, there was a need to perform the remaining toner amount detection in the fine detection mode by periodically interrupting the printing and then by lowering the stirring speed.

That is, in the image forming apparatus with high printing productivity, a toner consumption amount of the remaining toner is large and therefore notification of the remaining amount of the toner, capable of being subjected to the printing, to the user becomes inaccurate unless the remaining toner amount is detected frequently. For that reason, there is a possibility that a period in which the user prepares a next developing device cannot be obtained sufficiently and that a print stop time occurs due to no remaining toner amount.

SUMMARY OF THE INVENTION

A principal object of the present invention is to provide an image forming apparatus capable of performing accurate remaining developer amount detection and capable of effecting printing without impairing printing productivity and printing quality even during high-speed printing in a state in which the remaining toner amount is small.

According to an aspect of the present invention, there is provided an image forming apparatus comprising:

an image bearing member for bearing an electrostatic latent image;

a developer carrying member for developing a developer and for developing the electrostatic latent image with the developer;

a developer accommodating portion for accommodating the developer;

a detecting device, including a light emitting element and a light receiving element, for detecting a remaining developer amount in the developer accommodating portion by receiving light, which is emitted from the light emitting element and passes through an inside of the developer accommodating portion, by the light emitting portion; and a stirring member for stirring the developer by rotating in the developer accommodating portion, wherein the stirring member is rotated in a rotation period including a first period in which the stirring member crosses an optical path of the light from the light emitting element toward the light receiving element and including a second period in which the stirring member does not cross the optical path of the light from the light emitting element toward the light receiving element, and wherein the stirring member is rotated at a first rotational speed in the first period and is rotated at a second rotational speed higher than the first speed.

These and other objects, features and advantages of the present invention will become more apparent upon a consideration of the following description of the preferred embodiments of the present invention taken in conjunction with the accompanying drawings.

Figure 3:
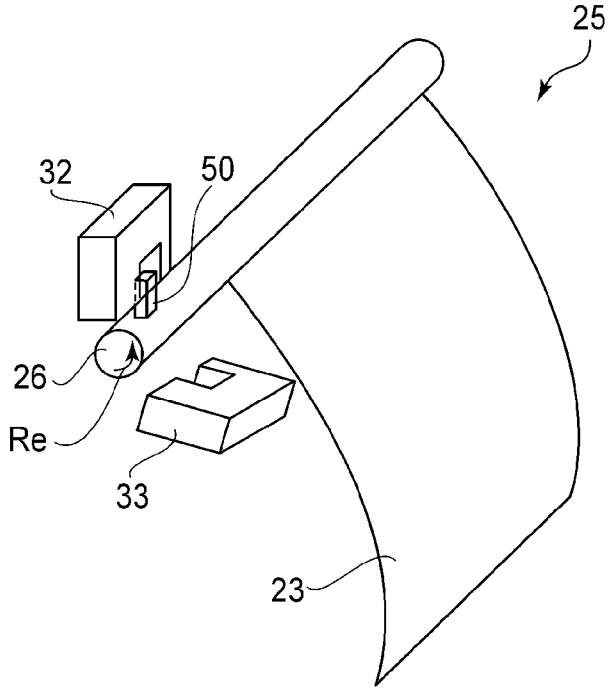
Figure 3:
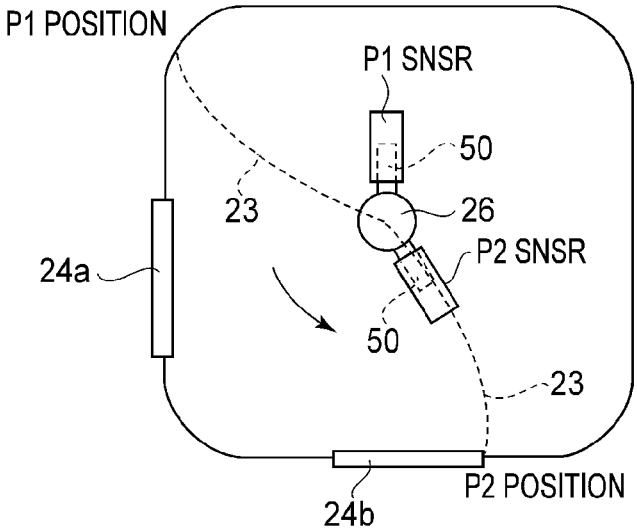

Parts (a) and (b) of FIG. 3 are schematic views for illustrating an arrangement of a stirring member P1 position sensor and a stirring member P2 position sensor and for illustrating a mechanism for detecting the presence of a sheet member at the P1 position or the P2 position in the image forming apparatus according to Embodiment 1 of the present invention.

Figure 4:
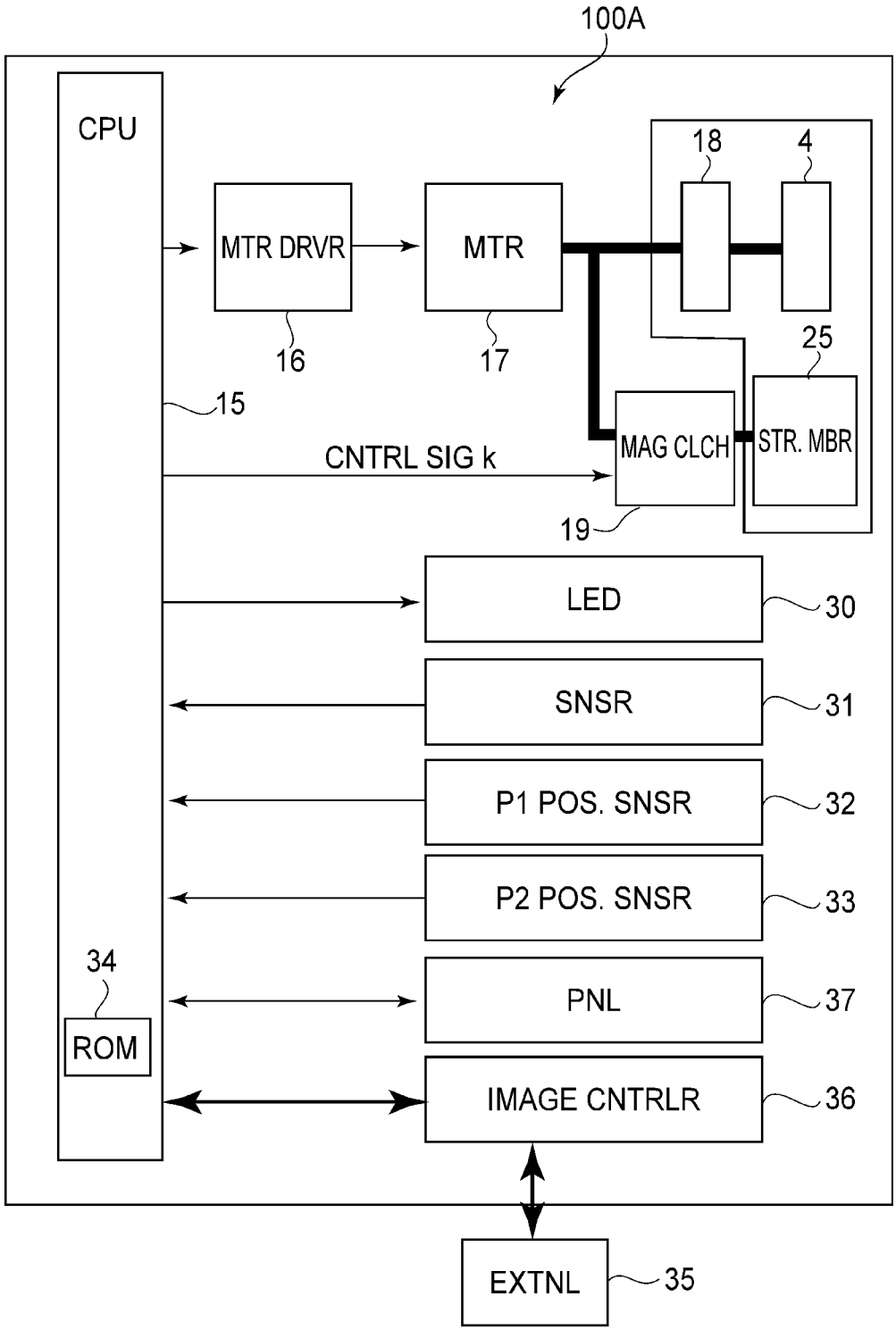

FIG. 4 is an electrical block diagram of the image forming apparatus of the present invention.

Figure 5:
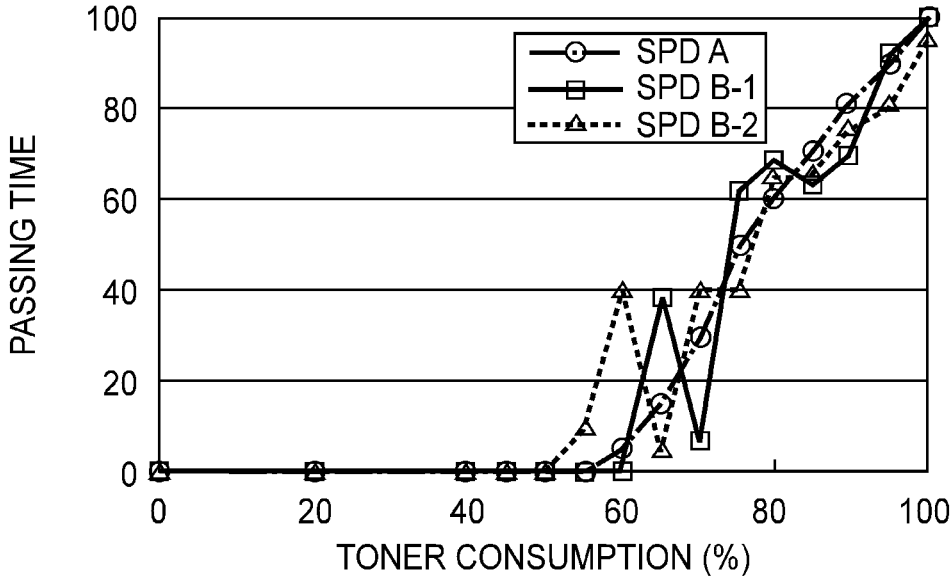

FIG. 5 is a graph showing a relationship between a toner consumption amount and a passing time when detection light L of a remaining developer amount detection device passes through an inside of a toner container in the image forming apparatus according to Embodiment 1 of the present invention.

Figure 6:
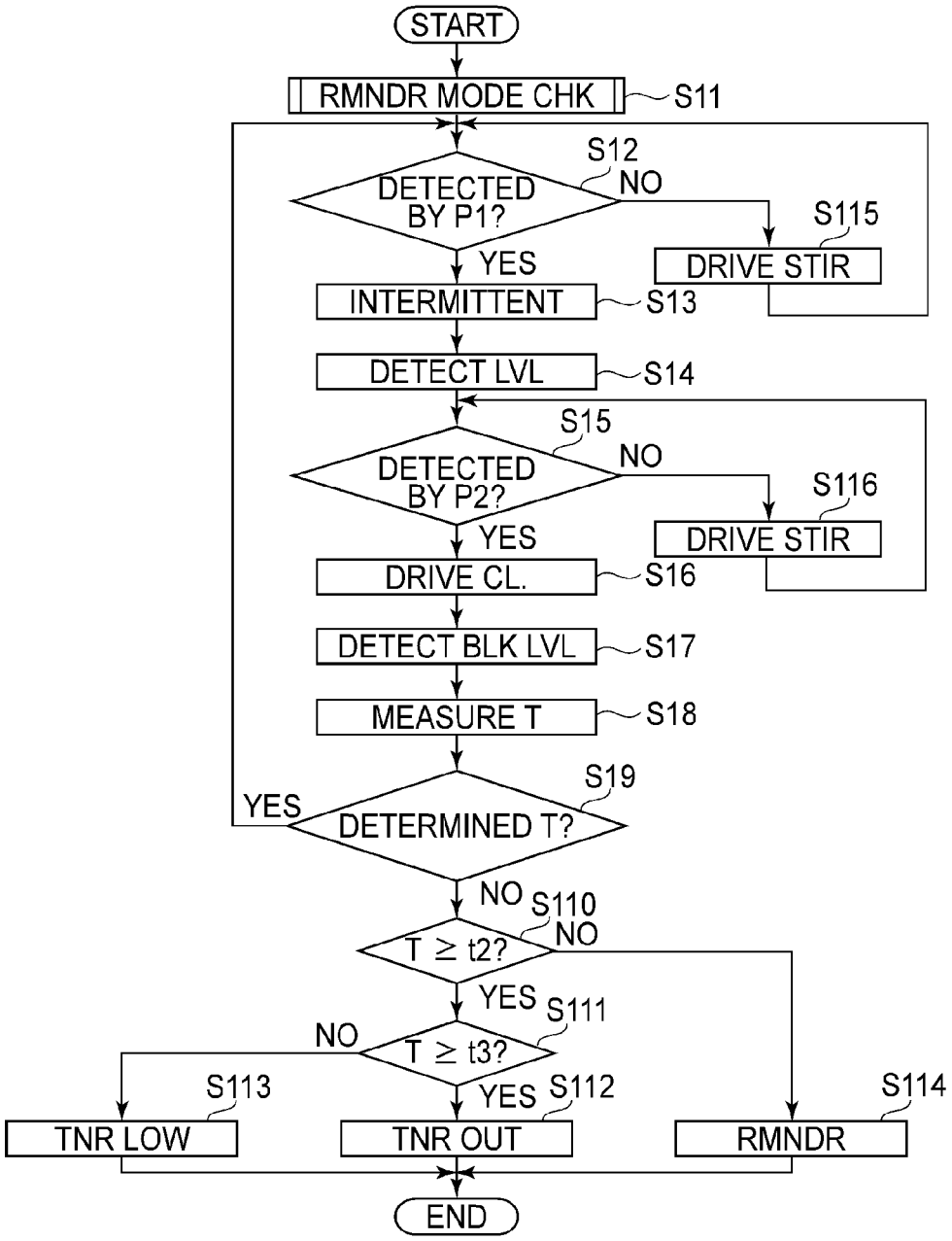

FIG. 6 is a flow chart for illustrating an operation of the image forming apparatus in Embodiment 1 of the present invention.

Figure 7:
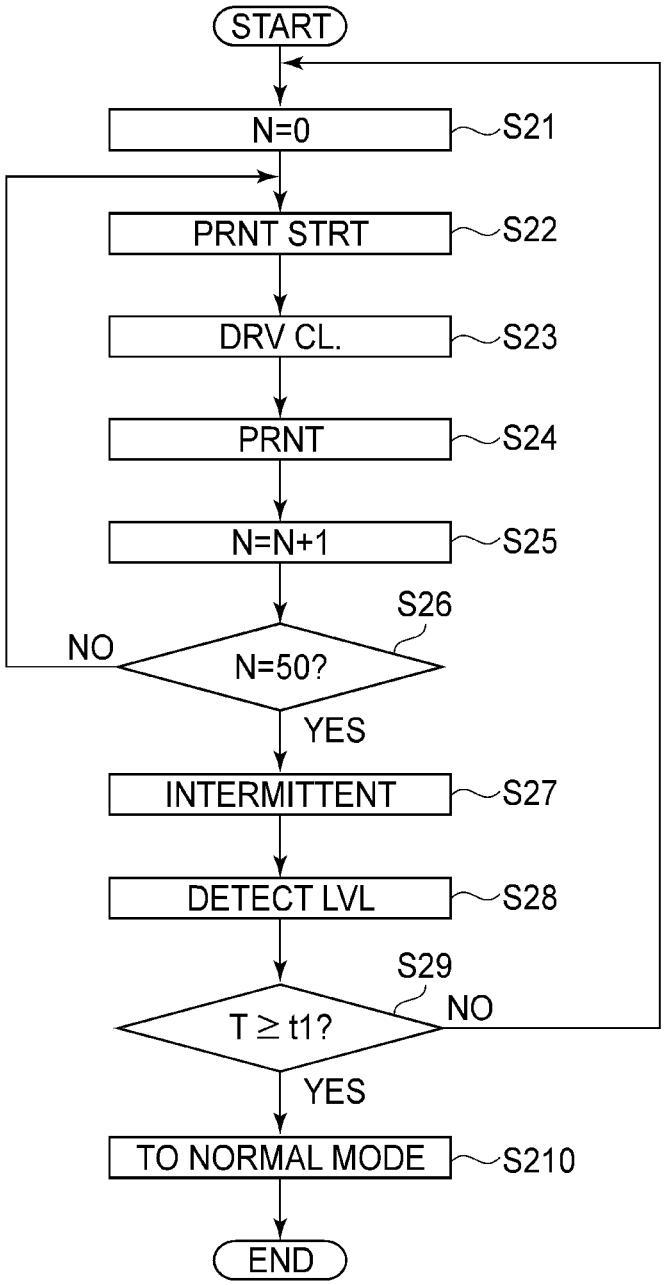

FIG. 7 is a flow chart for illustrating a detailed operation in S11 in the flow chart of FIG. 6.

Figure 8:
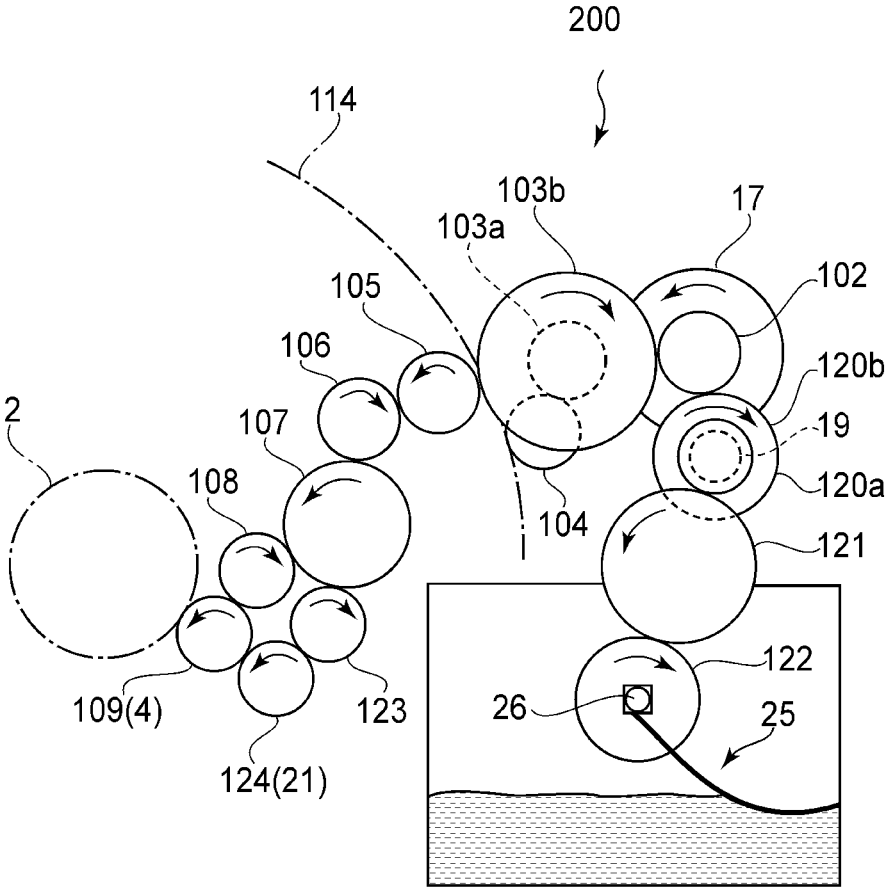

FIG. 8 is a schematic perspective view of a process cartridge in an image forming apparatus according to Embodiment 2 of the present invention.

Figure 9:
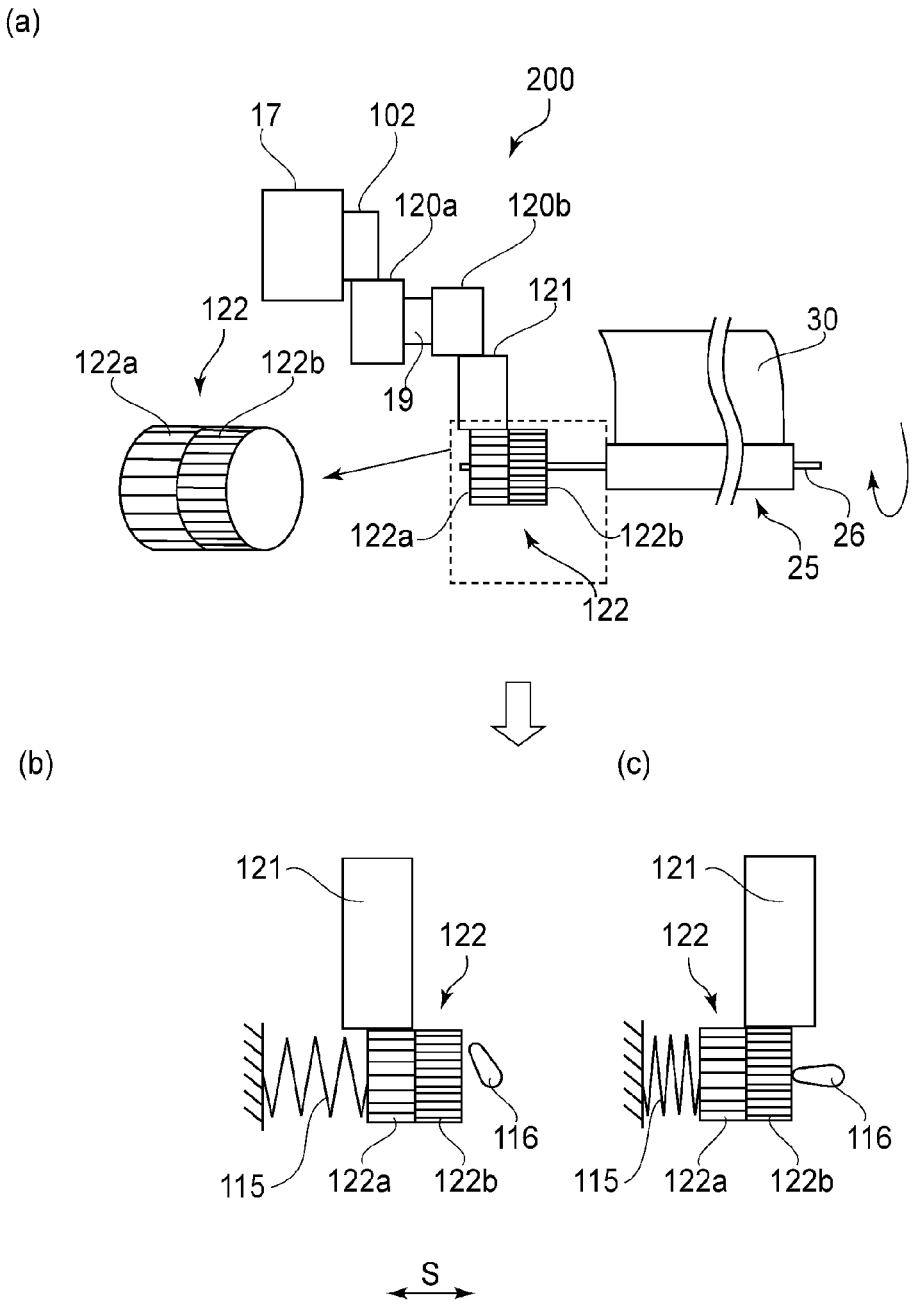

Parts (a), (b) and (c) of FIG. 9 are schematic views for illustrating a mechanical constitution of the image forming apparatus in Embodiment 2 of the present invention.

Figure 10:
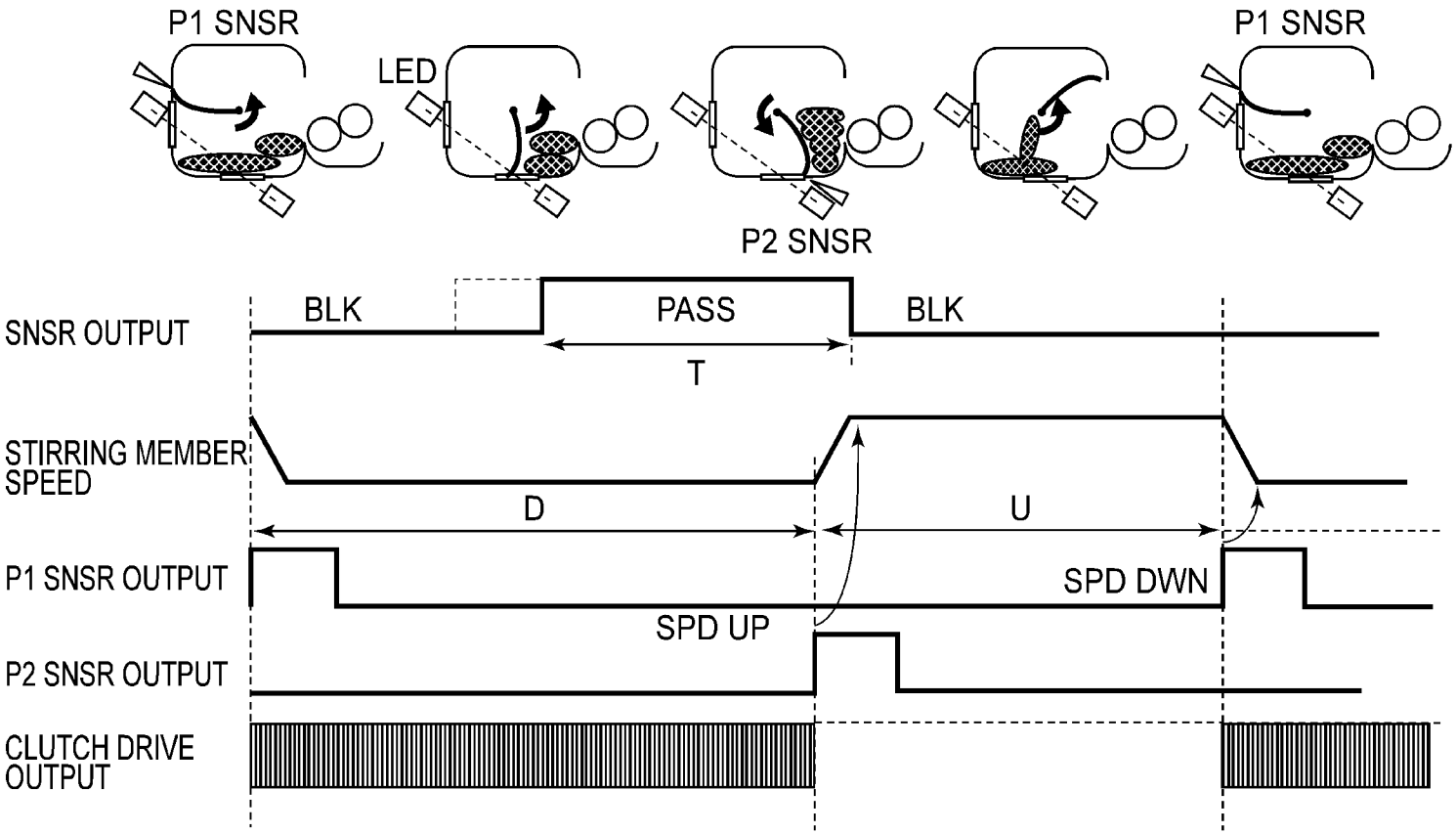

FIG. 10 is a timing chart showing light transmission remaining toner amount detection and speed control in the present invention.

DESCRIPTION OF THE PREFERRED EMBODIMENTS

Hereinbelow, the image forming apparatus according to the present invention will be described with reference to the drawings.

Embodiment 1

Figure 1:
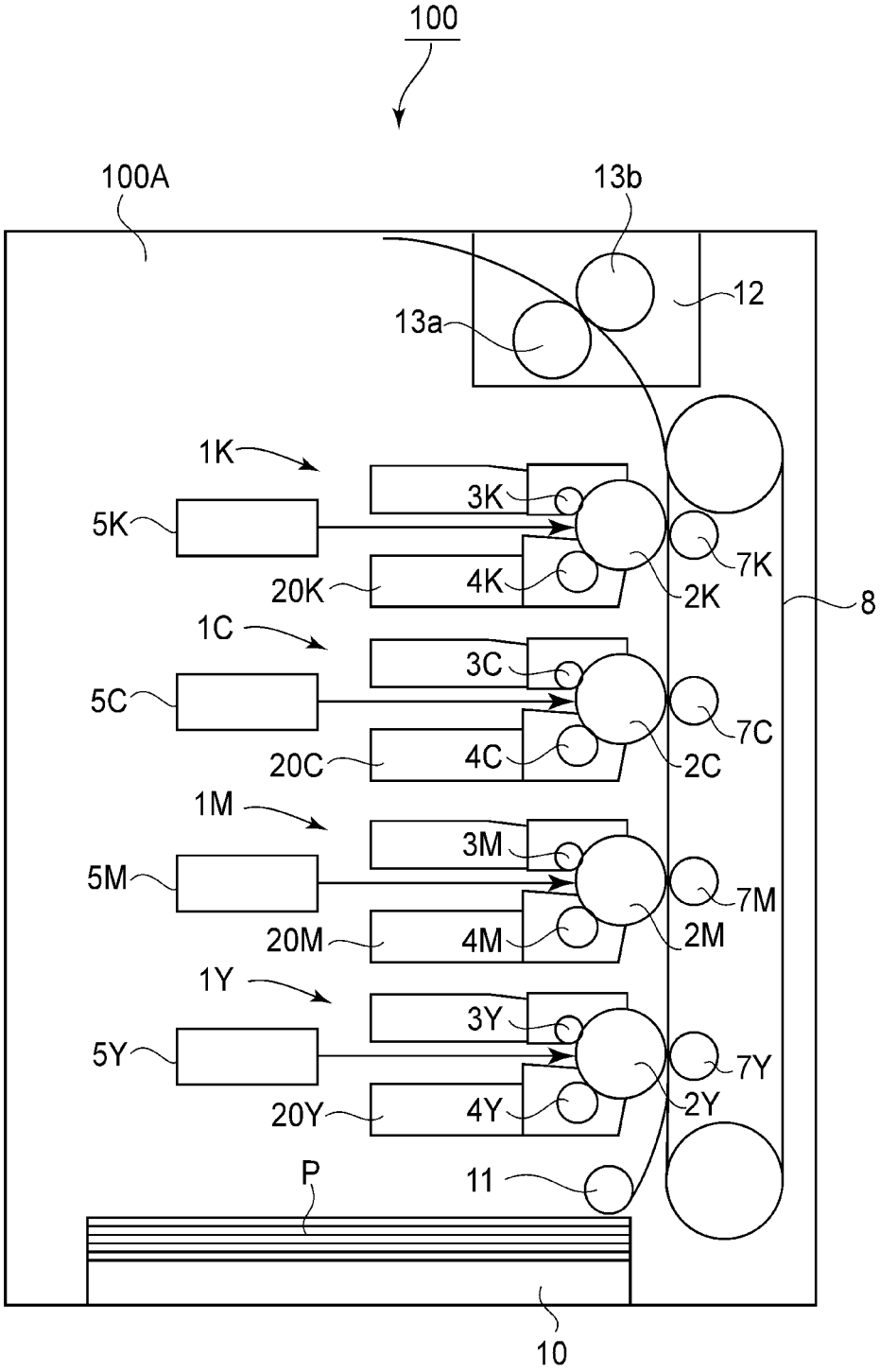
FIG. 1 is a schematic sectional view of an image forming apparatus according to Embodiment 1 of the present invention.

FIG. 1 shows a schematic structure of the image forming apparatus in this embodiment according to the present invention. According to this embodiment, the image forming apparatus of the present invention is embodied by a laser beam printer of an electrophotographic type (hereinafter simply referred to as a printer). However, the present invention is not limited thereto.

Referring to FIG. 1, a printer 100 in this embodiment includes process cartridges 1 (1Y, 1M, 1C and 1K) each detachably mountable to a printer main assembly 100A. These four process cartridges 1Y, 1M, 1C and 1K) have the same structure but are different in that images are formed with toners of different colors of yellow (Y), magenta (M), cyan (C) and black (K). The process cartridges 1Y, 1M, 1C and 1K include developer accommodating portions 20 (20Y, 20M, 20C and 20K), image bearing members 2 (2Y, 2M, 2C and 2K), charging means 3 (3Y, 3M, 3C and 3K) and developer carrying members 4 (4Y, 4M, 4C and 4K). Exposure means 5 (5Y, 5M, 5C and 5K) expose the image bearing members 2Y, 2M, 2C and 2K to light on the basis of an image signal.

Drum-like electrophotographic photosensitive members as the image bearing members, i.e., photosensitive drums 2 (2Y, 2M, 2C and 2K) are electrically charged by the charging rollers 3 (3Y, 3M<3C and 3K) as charging means to a predetermined potential of a negative polarity. Thereafter, electrostatic latent images are formed by laser units 5 (5Y, 5M, 5C and 5K) as the exposure means. These electrostatic latent images are reversely detected by developing rollers 4 (4Y, 4M, 4C and 4K) as the developer carrying members, so that negatively chargeable toner T is deposited to form toner images of Y, M, C and K. In this embodiment, as the developer, the negatively chargeable non-magnetic toner T which is one-component developer is used.

An electrostatic transfer belt 8 is vertically supported by four rollers and on an outer peripheral surface thereof at a left side of FIG. 1, electrostatically attracts a transfer material P and is circulated and moved in order to bring the transfer material P into contact to the photosensitive drums. As a result, the transfer material P is conveyed to a transfer position by the electrostatic transfer belt 8, and the toner image is transferred from the photosensitive drum 2 onto the transfer material P.

A sheet feeding portion feeds and conveys the transfer material P to an image forming portion, and a plurality of sheets of the transfer material P are accommodated in a sheet feeding cassette 10. During the image formation, a sheet feeding roller 11 is rotated by the image forming operation, so that the transfer material P in the sheet feeding cassette 10 is fed sheet by sheet. Then, the rotation of the electrostatic transfer belt 8 and an image writing position are synchronized with each other, and thus the transfer material P is fed to the electrostatic transfer belt 8.

When the transfer material P is fed to the electrostatic transfer belt 8, the process cartridges 1Y, 1M, 1C and 1K are successively driven by being timed to printing timing and by the drive of the process cartridges, the photosensitive drums 2Y, 2M, 2C and 2K are correspondingly driven rotationally in the counterclockwise direction. Then, the laser unit 5 corresponding to each process cartridge 1 emits a laser beam on the basis of image information, so that the electrostatic latent image is formed on the photosensitive drum 2.

The toner is deposited on the electrostatic latent image by the developing roller 4 to which the toner is supplied from a toner container 20 as the developer accommodating portion for accommodating the developer (toner), so that the toner image is formed on the peripheral surface of the photosensitive drum 2. Onto the transfer material P conveyed by the electrostatic transfer belt 8, by an electric field formed between each of the photosensitive drums 2 and each of transfer rollers 7 (7Y, 7M, 7C and 7K), the toner images are successively transferred from the respective photosensitive drums 2. The transfer material P on which the four color toner images are transferred is conveyed into a fixing portion 12.

The fixing portion 12 fixes the plurality of color toner images transferred on the transfer material P and applies heat and pressure to the transfer material P by a heating roller 13*a* and a pressing roller 13*b*. Thus, the plurality of color toner images are fixed on the surface of the transfer material P and then is discharged to the outside of the main assembly.

Figure 2:
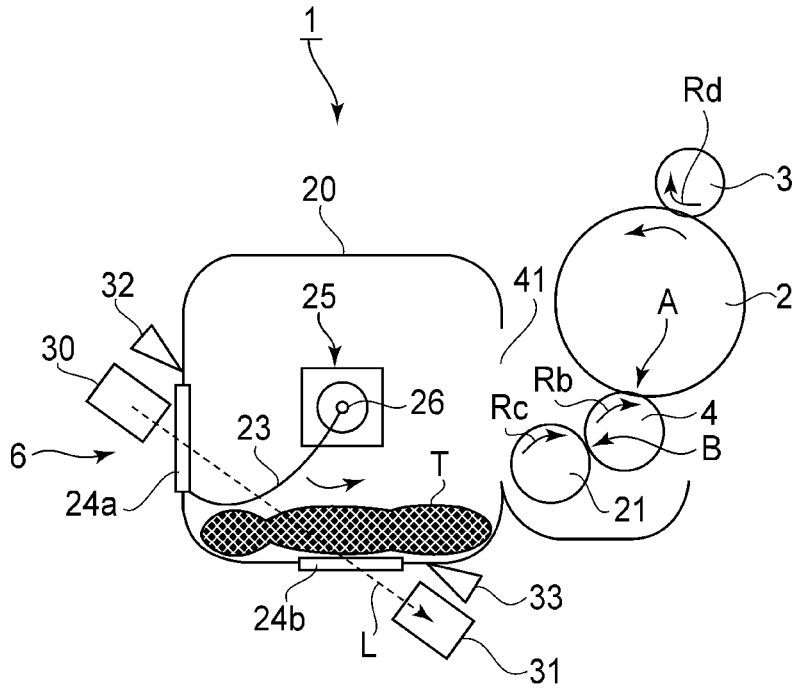
FIG. 2 is a schematic view of a process cartridge in the present invention.

FIG. 2 is a detailed view of the process cartridge 1. The process cartridges 1Y, 1M, 1C and 1K have the same structure. In the following description, suffixes Y, M, C and K for differentiate structural members for the process cartridges 1Y, 1M, 1C and 1K will be omitted and collectively described except the case where there is a need to differentiate the respective process cartridges 1.

The charging roller 3 is rotated in an arrow Rd direction in FIG. 2 by the rotation of the photosensitive drum 2. The charging roller 3 and the photosensitive drum 2 are contacted to each other substantially over the entire area with respect to a longitudinal direction (perpendicular to a conveyance direction of the transfer material P). A part of the toner container 20 opposing the photosensitive drum 2 is open to the photosensitive drum 2 over the substantially entire area with respect to the longitudinal direction of the photosensitive drum 2. At this opening 41, the developing roller 4 as the roller-like developer carrying member constituting the developer carrying member is disposed. The developing roller 4 is pressed and contacted to the photosensitive drum 2 at a developing portion A, in which the latent image on the photosensitive drum 2 is developed, so as to provide a predetermined entering amount, so that the developing roller 4 is rotationally driven in an arrow Rb direction.

In FIG. 2, at a lower left portion of the developing roller 4, an elastic roller 21 as a supplying means for forming a supply portion B where the toner is supplied to the developing roller 4 and as a means for removing the toner, which is not subjected to the development, from the developing roller 4. The elastic roller 21 is rotatably supported by the process cartridge 1. Further, the elastic roller 21 is a rubber sponge roller from the viewpoint of toner supply to the developing roller 4 and a removing property of the toner which is not subjected to the development, and is rotationally driven in an arrow Rc direction which is the same direction as the Rb direction of the developing roller 4.

By sliding on the elastic roller 21, the toner carried on the developing roller 4 is triboelectrically charged and regulated in a thin layer. To the developing roller 4, as a developing bias, a DC voltage fixed at a predetermined value is applied. As a result, in this embodiment, on the uniformly charged surface of the photosensitive drum 2, an exposed portion where the negative electric charges are attenuated is developed by reverse development.

In this embodiment, a stirring member (stirring means) 25 is rotatably supported by the toner container 20 and feeds the toner to the elastic roller 21 in a direction crossing the longitudinal direction of the control 1. The stirring member 25 periodically stirs the toner to supply the toner to the photosensitive drum 2 via the developing roller 4.

Next, a constitution of the stirring member 25 will be described with reference to FIGS. 2 and 3.

The stirring member 25 is prepared by attaching a flexible sheet member 23 to a rod member 25. By the periodical rotation of the stirring member 25 in the toner container 20, the sheet member 23 of the stirring member 25 scrapes away the toner T stagnated on the bottom of the toner container 20. Then, the toner T is sent to the outside of the toner container 20 through the opening 41 and thereafter is subjected to the development on the photosensitive drum 2 via the elastic roller (toner supplying roller) 21 and the developing roller 4.

In this embodiment, the stirring member 25 is, as shown in FIG. 4, rotationally driven together with the drive of the developing roller 4 by a motor 17 provided in the printer main assembly 100A. Incidentally, as will be described later, the stirring member 25 is capable of being variably rotationally driven by a driving force from the motor 17 by intermittently driving an electromagnetic clutch 19 by CPU 15.

Next, a light transmission remaining toner amount detecting method and its constitution will be described.

As shown in FIG. 2, the toner container 20 of the process cartridge 1 in which the toner T is applied is provided with a light transmitting window 24*a* and a light transmitting window 24*b*. Further, the printer main assembly 100A is provided, in the neighborhood of the toner container 20, with a remaining toner amount detecting LED (light emitting means) 30 and a remaining toner amount detecting sensor (light receiving means) 31 which constitute the remaining toner amount detecting means.

According to a remaining developer amount detecting device 6 as a light transmission remaining developer amount detecting means in this embodiment, detection light L emitted from the remaining toner amount detecting LED 30 enters the inside of the toner container 20 through the light transmitting window 24*a*. Then, the detection light L having entered the inside of the toner container 20 passes through the light transmitting window 24*b* to reach the outside of the toner container 20. The detection light 20 coming out of the toner container 20 reaches the remaining toner amount sensor 31. Depending on an amount of the detection light L in a time detected by the remaining toner amount sensor 31, i.e., on the basis of a detected value of the remaining toner amount sensor 31, the remaining amount of the toner T accommodated in the toner container 20 is detected.

Incidentally, the sheet member 23 of the stirring member 25 enters the light transmitting windows 24*a* and 24*b* at a part of its longitudinal region by about 0.5 mm to about 4 mm, thus also having the function of wiping the toner deposited on the surfaces of the light transmitting windows 24*a* and 24*b*. By employing such a constitution, even when the surfaces of the light transmitting windows 24*a* and 24*b* are covered with the toner, the surfaces of the light transmitting windows 24*a* and 24*b* are cleaned by the sheet member 23, so that the detection light L can pass through the inside of the toner container 20. In a state in which the toner T is present in a large amount in the toner container 20, even when the surfaces of the light transmitting windows 24*a* and 24*b* are cleaned by the sheet member 23, the surfaces of the light transmitting windows 24*a* and 24*b* are covered with the toner immediately to light-block the light transmitting windows 24*a* and 24*b*, so that a passing time of the detection light L through the inside of the toner container 20 is short.

However, when the toner T in the toner container 20 is consumed and the remaining amount becomes small, a time interval from the completion of the cleaning of the light transmitting windows 24*a* and 24*b* with the sheet member 23 until the light transmitting windows 24*a* and 24*b* are covered with the toner T again is increased. For that reason, the passing time of the detection light L through the inside of the toner container 20 correspondingly becomes long. Thus, in the light transmission remaining developer amount detecting device 6, the remaining amount of the toner T in the toner container 20 is measured depending on a change in length of passing time of the detection light L through the inside of the toner container 20.

That is, in the state in which the toner T is present in the large amount in the toner container 20, the detection light L does not pass through the inside of the toner container 20. On the other hand, in a state in which the toner T is consumed, the detection light L can be obtained and the passing time thereof is increased with an increase in degree of the consumption of the toner T. Therefore, the passing time of the detection light L when there is no toner T in the toner container 20 is set at a threshold Y in advance. Then, when the passing time of the detection light L through the inside of the toner container 20 reaches the threshold Y, it is possible to notify the user of the absence of the toner T.

Further, a remaining toner amount detection sequence in which the passing time of the detection light L having passed through the inside of the toner container 20 and the remaining amount of the toner T in the toner container 20 are associated with each other is prepared. As a result, it becomes possible to perform real-time detection of the remaining amount of the toner T by which the remaining amount of the toner T in the toner container 20 is notified to the user in real time correspondingly to the detection light L passing time in the toner container 20.

Further, on the outer peripheral surface of the toner container 20, a stirring member P1 position sensor 32 for detecting the sheet member 23 at a first position (P1 position) when the sheet member 23 is rotationally driven and a stirring member P2 position sensor 33 for detecting the sheet member 23 at a second position (P2 position) when the sheet member 23 is rotationally driven are disposed.

Parts (a) and (b) of FIG. 3 show a constitution and arrangement of the stirring member P1 position sensor 32 and the stirring member P2 position sensor 33.

In (a) of FIG. 3, at an end portion of the rod member 26 of the stirring member 25, a sensor flag 50 is integrally provided and is rotated by rotational drive of the rod member 26 in an arrow Re direction. Around the rod member 26, the stirring member P1 position sensor 32 and the stirring member P2 position sensor 33 are disposed. Each of the stirring member P1 position sensor 32 and the stirring member P2 position sensor 33 is constituted by a photo-interrupter and can detect passing of the sensor flag 50 since each sensor is light-blocked when the sensor flag 50 is rotated to cross each sensor. The stirring member P1 position sensor 32 and the stirring member P2 position sensor 33 are disposed so that they can detect passing of the sheet member 23 attached to the rod member 26 through the P1 position and the P2 position, respectively. Part (b) of FIG. 3 is a sectional view showing a state of the sensor flag 50 which is located at the position of the stirring member P1 position sensor 32 when the sheet member 23 is located at the P1 position and which is located at the position of the stirring member P2 position sensor 33 when the sheet member 23 is located at the P2 position.

By the rotation of the stirring member 25 in the toner container 20, the sheet member 23 of the stirring member 25 scraped away the toner T stagnated on the bottom of the toner container 20.

Next, with reference to FIG. 4, an electrical block diagram in this embodiment will be described.

In FIG. 4, the CPU 15 computes the remaining toner amount on the basis of turning-on/off control of the remaining toner amount detecting LED 30 and a signal from the remaining toner amount detecting sensor 31. Further, the CPU 15 effects control such as drive control of the motor 17 and the electromagnetic clutch 19 and display control of an operation panel 37. ROM 34 stores a program for executing a sequence of the CPU 15. A motor driving circuit 16 and the motor 17 are used for driving the members of the process cartridge 1 such as the developing roller 4, the stirring member 25 and the photosensitive drum 2. A developing roller driving unit 18 for driving the developing roller 4 and the electromagnetic clutch 19 are controlled by a control signal K from the CPU 15 as to whether or not the driving force from the motor 17 should be transmitted to the stirring member 25.

The operation panel 37 receives input of print setting by the user or effects display for providing notification of a printer status (error, warning) to the user. An image controller 36 converts an image signal from an external device 35 into bitmapped data and sends the bitmapped data to the CPU 15.

Here, a relationship between a stirring speed and remaining toner amount detection accuracy in this embodiment will be described.

FIG. 5 is a graph showing an example of a relationship between a toner consumption amount in the toner container 20 and the passing time, in which the detection light L of the remaining developer amount detecting device passes through the inside of the toner container 20, with respect to a first stirring speed and a second stirring speed.

In this embodiment, a speed A (first stirring speed) as the stirring speed in taken as G and a speed B (second stirring speed) as the stirring speed is taken as 2G. Further, the speed B includes a speed B-1 and a speed B-2 which are data obtained at the speed B. When the toner consumption amount on the abscissa is 0%, the process cartridge 1 is in an initial state in which the toner T is filled in the toner container 20 in a predetermined amount. When the toner consumption amount is 100%, the process cartridge 1 is in a state in which the toner T in the toner container 20 is consumed and the process cartridge 1 should be exchanged.

The passing time of the detection light L on the ordinate represents a time in which the detection light L of the remaining developer amount detecting device 6 passes through the inside of the toner container 20. In the state in which the toner T is present in the large amount in the toner container 20, the detection light L is completely blocked by the toner T and therefore cannot pass through the inside of the toner container 20. When the toner T in the toner container 20 is partly consumed, the detection light L is started to slightly pass through the inside of the toner container 20, so that the passing time of the detection light L can be obtained. Then, as the toner T in the toner container 20 is further consumed and the remaining amount of the toner T is decreased, the passing time of the detection light L having passed through the inside of the toner container 20 is increased (i.e., prolonged). Here, the passing time in a state in which no detection light L pass through the inside of the toner container 20 is taken as 0, and the passing time in a state in which the detection light L continuously passes through the inside of the toner container 20 is taken as 100. When the passing time is 100, the process cartridge 1 is in the exchange state in which the process cartridge 1 used should be exchanged.

As shown in FIG. 5, in this embodiment, in the case where the remaining toner amount is very large, the detection light cannot be obtained irrespective of the stirring speed (stirring drive speed), so that the passing time of the detection light is in the state of 0 (zero). When the toner is gradually consumed and the remaining toner amount reaches about 60%, the detection light is started to be obtained but in this state, the passing time of the detection light varies depending on the stirring speed.

Particularly, at a faster speed B as the stirring speed, a degree of variation in position sensor becomes large. On the other hand, at a slower speed A as the stirring speed, a stable passing time of the detection light is obtained. This is because the toner T in the toner container 20 is always in a cloud state at the faster stirring speed and remains at the bottom of the toner container 20, after being placed in the cloud state, at the slower stirring speed.

That is, in the case where the remaining toner amount is large and the stirring speed is fast, the toner is always in the cloud state and has a large density, so that the detection light is less liable to pass through the inside of the toner container and the stable passing time cannot be obtained. In the case where the remaining toner amount is large and the stirring speed is slow, the toner is placed in the cloud state with a low density and then remains at the toner container bottom, so that the detection light is liable to pass through the inside of the toner container (at an interval between low-density cloud state periods) and the stable passing time can be obtained.

In the case where the remaining toner amount is small and the stirring speed is fast, the toner is always in the cloud state but is liable to pass through the inside of the toner container since the toner density is small. For that reason, the degree of the variation in passing time of the detection light is decreased but, e.g., as shown by the passing time at 100% of the toner consumption amount for the speed B-2, the remaining toner amount judged from the passing time is in a state in which the image is still formable (printable).

In view of the above result, in this embodiment, in order to feed (supply) the toner from the stirring member 25 to the developing roller 4 and the photosensitive drum 2, the toner is stirred at the faster stirring speed and thereafter is stirred at the slower stirring speed, thus being placed in the low-density cloud state. In this state, the time in which the detection light L emitted from the remaining toner amount detecting LED 30 pass through the inside of the toner container 20 and reaches the remaining toner amount detecting sensor 31 is measured and thereafter the stirring speed is changed again to the faster stirring speed, so that even during the high-speed printing, the remaining toner amount can be detected while satisfying the toner supply.

That is, the stirring member 25 is decreased in stirring speed with detection timing when the stirring member 25 passes through an optical remaining amount detecting position in one rotation period of the stirring member 25, and is driven at a faster stirring speed with timing other than the detection timing.

Here, in this embodiment, from a fresh state of the process cartridge 1 until the passing time of the detection light L is first obtained, the stirring speed during a normal operation is set at the speed B and the remaining amount detection is performed every 50 sheets. When the remaining toner amount is decreased and the passing time of the detection light L is obtained, the operation in the fine (precise) remaining toner amount detecting mode is performed. After an accurate remaining toner amount is obtained in the fine remaining toner amount detecting mode, the image formation (printing) on a predetermined number of sheets is effected again in the rough remaining toner amount detecting mode and then the operation in the fine remaining toner amount detecting mode is performed again. This procedure is repeated and the accurate remaining toner amount is obtained while gradually decreasing the predetermined number of sheets depending on the remaining toner amount obtained in the fine remaining toner amount detecting mode, so that it is possible to accurately obtain timing when the process cartridge 1 is in the exchange state.

In this embodiment, the remaining toner amount detecting sequence will be described along flow charts shown in FIGS. 6 and 7.

First, a remaining toner amount mode check is performed in S11. S11 is a step for determining, depending on the remaining toner amount, whether or not a full-time remaining toner amount detecting mode (in which the remaining amount detection is performed every printing on one sheet). Details of this step (S11) will be described along the flow chart of FIG. 7.

In S21 a counter N for the print number is at 0 (zero). When the printing is started (S22), the electromagnetic clutch 19 is continuously driven (S23). When the electromagnetic clutch 19 is continuously driven, the toner is stirred at the speed B as the stirring speed of the stirring member 25. Every printing (S24), the counter N is incremented by one (+1) (S25). When the print counter N indicates 50, the electromagnetic clutch 19 is intermittently driven in an amount corresponding to one sheet and the stirring speed is decreased to the speed A, and then the detection light is emitted from the remaining toner amount detecting LED and its transmission level is detected by the remaining toner amount detecting sensor (S26, S27 and S28).

Whether or not a transmission time T obtained from the remaining toner amount detecting sensor is t1 is more is checked (S29). When the transmission time T is t1 or more, the operation goes to the full-time remaining toner amount detecting mode and then the remaining toner amount detection is effected every printing (on one sheet) (S210). When the transmission time T is less than t2, the remaining toner amount is sufficient and the process cartridge is in a state in which there is no need for the user to prepare a fresh process cartridge. In this case, the counter N is reset to 0 (zero), and the transmission time T is measured again by the remaining toner amount detecting sensor after the printing on subsequent 50 sheets.

The operation is returned to the flow chart of FIG. 6 and is goes to the full-time remaining toner amount detecting mode and thereafter during the printing, the stirring member 25 is detected at the P1 position by the stirring member P1 position sensor 32 when the stirring member 25 is rotationally moved in the toner container 20 (S12), the electromagnetic clutch 19 is intermittently driven (S13).

When the electromagnetic clutch 19 is intermittently driven, the stirring member 25 repeats its rotation and rotation stop and therefore in a period of the intermittent drive, an average speed of the stirring member 25 is decreased. The intermittent drive of the electromagnetic clutch 19 is continued until the stirring member 25 is detected by the stirring member P2 position sensor 33. The transmission level is detected by the remaining toner amount detecting sensor 31 (S14).

Until the presence of the stirring member 25 at the P2 position is detected by the stirring member P2 position sensor 33 is S15, the stirring member 25 is rotationally driven (S116). When the stirring member 25 reaches the P2 position, the electromagnetic clutch is continuously driven, so that the stirring speed is increased from the speed A to the speed between B (S16). In S17, a light-blocking level is detected by the remaining toner amount detecting sensor 31. In S18, the transmission time T of the transmission level is measured. The steps from S12 to S18 are repeated a predetermined number of times and when the measurement result is converged, the transmission time T for determining the remaining toner amount is determined (S19).

Whether or not the transmission time T of the transmission level is t2 or more is checked (5110). The value t2 is a threshold corresponding to the remaining toner amount of 15%. When the transmission time T obtained by the remaining toner amount detecting sensor 31 is t2 or more, whether or not the transmission time is t3 or more is checked (S111). The value t3 is a threshold corresponding to the remaining toner amount of 3%.

In the case where the transmission time T is t2 or more and less than t3, "TONER LOW" is displayed at the operation panel and warning for urging the user to prepare the process cartridge exchange is provided (S112). In the case where the transmission time T is t3 or more, "TONER OUT" is displayed on the operation panel and warning for urging the user to urgently prepare a fresh process cartridge (S113). In the case where the transmission time T is less than t2, the remaining toner amount depending on the transmission time T is displayed in real time (S114). At the displayed level, the remaining toner amount is sufficient and the display massage is not the warning.

Incidentally, at the P1 position, the toner is scooped up at the stirring speed B and then is in the low-density cloud state. At the P2 position, the stirring member 25 passes through the light transmitting window 24*b* to start supply of the toner to the developing roller 4.

In this embodiment, by performing the remaining toner amount detecting sequence, it becomes possible to detect the remaining toner amount without impairing the printing productivity while effecting the image formation in a high-speed printing state. Further, even in a state in which the toner in the toner container is consumed and the remaining toner amount is small, it is possible to perform the remaining toner amount detection with high accuracy, without impairing the printing productivity, to the possible extent.

Incidentally, in this embodiment, the passing time (transmission time) T of the detection light L and the print (interval) number N may be selected as a suitable value depending on the image forming apparatus used.

Further, the present invention is also applicable to the case where the image forming apparatus is not of the process cartridge type. In that case, an effect similar to that in this embodiment can be achieved.

Embodiment 2

Embodiment 2 will be described with reference to FIGS. 8 and 9. FIGS. 8 and 9 illustrate a drive transmission member 200 for the process cartridge 1.

A driving force of a main assembly motor 17 provided in the printer main assembly 100A is transmitted from a driving gear to stepped gears 103 (103*a*, 103*b*). The driving force from the stepped gears 103 is branched, so that a part of the driving force is transmitted from the stepped gear 103*a* to a photosensitive drum-side gear 104 and a remaining driving force is transmitted from the stepped gear 103*b* to a toner container-side gear 105.

The driving force from the toner container-side gear 105 is further transmitted to gears 106, 107, 108 and 109, so that the developing roller 4 provided coaxially with the gear 109 is driven. The driving force from the gear 107 is transmitted to gears 123 and 124, so that the toner supply roller 21 provided coaxially with the gear 124 is driven.

On the other hand, as described above, the driving force transmitted from the stepped gear 103*a* to the photosensitive drum-side gear 104 is further transmitted from the gear 104 to a gear 114, so that the photosensitive drum 2 is driven.

The process cartridge 1 is constituted by the developing roller 4, as the developer carrying member, contacted to the photosensitive drum 2, and the toner container 20 in which the developing roller 4 is disposed.

In the toner container 20, the stirring member 25 for feeding the toner to the developing roller 4 is provided. Similarly as the developing roller 4, with respect to the stirring member 25, the driving force of the main assembly motor 17 is transmitted from the driving gear 102 to a gear 120*a*. A gear 102*b* is provided coaxially with the gear 120*a* through the electromagnetic clutch 19. The driving force from the gar 120*b* is transmitted to gears 120 and 121, so that the stirring member 25 provided coaxially with the gear 122 is driven.

During development, when the accommodated toner is fed to the developing roller 4 by the stirring member 25, the toner carried on the developing roller 4 is regulated by the rotation of the developing roller 4 to be formed in a thin layer. The regulated toner reaches the charging roller 3 as a developer charging means by the rotation of the developing roller 4, so that a desired electric charge amount is imparted to the toner.

Part (a) of FIG. 9 is a side view of a gear train for driving the stirring member 25 in the process cartridge 1 shown in FIG. 8, wherein the gear train includes the gears 102 and 120*a*, the electromagnetic clutch 19 and the gears 120*b*, 121 and 122. The gear 122 is the stepped gear consisting of the two gears 122*a* and 122*b* which are different in gear ratio to the 121 so that the gear ratio of the gear 122*b* is higher (larger in teeth number) than that of the gear 122*a*. The stepped gear 122 is, as shown in (b) and (c) of FIG. 9, urged and unurged by a cam 116 so as to slide in an arrow S direction. A spring 115 is supported by the image forming apparatus main assembly 100A and applies pressure to the stepped gear 122 in the rightward arrow S direction in (b) and (c) of FIG. 9.

Parts (b) and (c) of FIG. 9 are schematic views showing a state in which the driving force from the motor 17 is transmitted to the stirring member 25 through the stepped gear 122*a* by unurging the stepped gear 122 with the cam 116 and a state in which the driving force is transmitted through the stepped gear 122*b* by urging the stepped gear 122 with the cam 116, respectively.

In (b) of FIG. 9, the driving force is transmitted to the stirring member 25 by the gear 122*b*. The urging timing of the cam 116 is, as shown in FIG. 10, such that the urging by the cam 116 is performed in a period from the detection of the stirring member 25 at the P1 position by the stirring member P1 position sensor 32 during the rotational drive of the stirring member 25 in the toner container 20 until the stirring member is detected at the P2 position by the stirring member P2 position sensor 33 (hereinafter referred to as a period D). Further, the urging by the cam 116 is not performed in a detect from the detection of the stirring member 25 at the P2 position by the stirring member P2 position sensor 33 to the detection of the stirring member 25 at the P1 position by the stirring member P1 position sensor 32 (hereinafter referred to as a period U). For this reason, the driving force from the motor 17 is, in the period D, drive-connected to the stirring member 25 by the stepped gear 122*b* and is, in the period U, drive-connected to the stirring member 25 by the stepped gear 122*a*. That is, the stirring speed of the stirring member 25 is the speed A in the period D and is the speed B in the period U.

As described above, the stirring speed is variably changed by switching a period in which the remaining toner amount is detected by the sensor and a period in which the toner is fed from the toner container to the developing roller by a mechanical mechanism providing the different gear ratios. As a result, the stirring speed is decreased in the period in which the remaining toner amount is detected by the sensor and is increased in the period in which the toner is fed from the toner container to the developing roller, so that it becomes possible to detect the remaining toner amount in real time while performing the high-speed printing.

The above-described embodiments and their actions and effects are summarized as follows.

(1) According to an embodiment of the present invention, the image bearing member, the developing portion for developing the latent image formed on the image bearing member, the supplying (feeding) portion for supplying the developer to the image bearing member, and the remaining developer amount detecting mean for detecting the remaining developer amount in the developing portion in which the developer is accommodated can be provided at different positions.

As a result, the stirring speed can be changed depending on each of the position in which the remaining developer amount is detected and the position in which the developer is supplied to the developer carrying member.

(2) According to the other embodiment of the present invention, it is possible to provide different periods consisting of the period in which the remaining developer amount is detected when the stirring member is periodically driven and the period in which the developer is supplied to the image bearing member.

As a result, the driving speed in the period in which the remaining developer amount is detected when the stirring member is periodically driven and that in the period in which the developer is supplied to the developer carrying member can be changed from each other.

(3) According to the other embodiment of the present invention, the driving speed when the stirring member is periodically driven by the stirring member driving means depending on the result of the detected value from the light receiving means by the remaining developer amount detecting means can be kept at a constant level.

As a result, in a state in which the remaining toner amount is sufficient and the transmitted light from the light emitting means cannot be detected, the remaining toner amount detecting sequence can be performed intermittently, so that it becomes possible to reduce power consumption of the light emitting means and the light receiving means.

(4) According to the other embodiment of the present invention, when the stirring member is periodically driven by the stirring member driving means, the driving speed in the remaining developer amount detecting period is variably changed depending on the remaining developer amount in the developer accommodating container.

As a result, the detection accuracy of the remaining toner amount is improved.

(5) According to the other embodiment of the present invention, at least the image bearing member, the developing portion and the stirring member are integrally assembled into the process cartridge, which is detachably mountable to the image forming apparatus main assembly.

As a result, it becomes possible to smoothly provide notification of exchange timing.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 117724/2010 filed May 21, 2010, which is hereby incorporated by reference.

What is claimed is:

1. An image forming apparatus comprising:

an image bearing member for bearing a latent image;

a developer carrying member for developing the latent image with a developer;

a developer accommodating portion for accommodating the developer;

a detecting device, including a light emitting element and a light receiving element, for detecting a remaining developer amount in said developer accommodating portion by receiving light; and a stirring member for stirring the developer by rotating in said developer accommodating portion, wherein said stirring member is rotated in a first period in which said stirring member crosses an optical path of the light from the light emitting element toward the light receiving element and a second period in which said stirring member does not cross the optical path of the light from the light emitting element toward the light receiving element, and wherein said stirring member is rotated at a first rotational speed in the first period and is rotated at a second rotational speed in the second period higher than the first rotational speed, and wherein the first period and the second period are included in one rotation of said stirring member.

2. An apparatus according to claim 1, further comprising a first gear and a second gear, smaller in number of teeth than said first gear, which are provided on a single rotational axis, and comprising a drive transmitting member for transmitting a driving force to said stirring member via said first gear in the first period and for transmitting the driving force to said stirring member via said second gear in the second period, wherein transition from the first period to the second period is effected by sliding said first gear and said second gear in a direction of the rotational axis.

3. An apparatus according to claim 1, further comprising a clutch for transmitting a driving force to said stirring member in the first period and for transmitting the driving force to said stirring member in the second period.

4. An apparatus according to claim 1, wherein at least said image bearing member, said developer carrying member, said developer accommodating portion and said stirring member are integrally assembled into a process cartridge, and wherein the process cartridge is detachably mountable to a main assembly of said image forming apparatus.

5. A developer accommodating apparatus comprising:

a developer accommodating portion for accommodating the developer;

a detecting device, including a light emitting element and a light receiving element, for detecting a remaining developer amount in said developer accommodating portion by receiving light; and a stirring member for stirring the developer by rotating in said developer accommodating portion, wherein said stirring member is rotated in a first period in which said stirring member crosses an optical path of the light from the light emitting element toward the light receiving element and a second period in which said stirring member does not cross the optical path of the light from the light emitting element toward the light receiving element, and wherein said stirring member is rotated at a first rotational speed in the first period and is rotated at a second rotational speed in the second period higher than the first rotational speed, and wherein the first period and the second period are included in one rotation of said stirring member.

* * * * *